US008575079B2

(12) United States Patent
Hwang et al.

(10) Patent No.: US 8,575,079 B2
(45) Date of Patent: Nov. 5, 2013

(54) LUBE OIL COMPOSITIONS

(75) Inventors: Gan-Lin Hwang, Tainan (TW); Ting-Yao Su, Pingtung County (TW); Woan-Shiow Tzeng, Hsinchu (TW); Hsin-Yi Wu, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 719 days.

(21) Appl. No.: 12/114,488

(22) Filed: May 2, 2008

(65) Prior Publication Data

US 2009/0170733 A1 Jul. 2, 2009

(30) Foreign Application Priority Data

Dec. 31, 2007 (TW) ..... 96151444 A

(51) Int. Cl.
*C10M 113/02* (2006.01)
*D01F 9/12* (2006.01)

(52) U.S. Cl.
USPC ..... 508/130; 508/113; 508/116; 508/120; 508/123; 508/125; 508/128; 508/129; 508/131

(58) Field of Classification Search
USPC ..... 508/113, 123, 125, 128, 129, 131, 745, 508/778–787, 116, 120; 977/742, 745, 977/778–787; 123/1 A
See application file for complete search history.

(56) References Cited

U.S. PATENT DOCUMENTS

| | | | | |
|---|---|---|---|---|
| 5,292,444 | A * | 3/1994 | Patil et al. | 508/454 |
| 5,454,961 | A * | 10/1995 | Schriver et al. | 508/184 |
| 6,828,282 | B2 * | 12/2004 | Moy et al. | 508/109 |
| 7,396,521 | B2 * | 7/2008 | Hwang | 423/447.1 |
| 7,727,414 | B2 * | 6/2010 | Hwang | 252/71 |
| 2004/0238799 | A1 * | 12/2004 | Hwang et al. | 252/511 |
| 2007/0122335 | A1 | 5/2007 | Hwang | |
| 2007/0292698 | A1 * | 12/2007 | Gause | 428/457 |
| 2010/0108937 | A1 * | 5/2010 | Hwang | 252/73 |

FOREIGN PATENT DOCUMENTS

| | | | |
|---|---|---|---|
| GB | 2432841 | A * | 6/2007 |
| JP | 2004331737 | A | 11/2004 |
| JP | 2007153727 | A | 6/2007 |
| JP | 2007154161 | A | 6/2007 |

OTHER PUBLICATIONS

Office Action for Application No. JP2008-326968, Japanese Patent Office, Jan. 16, 2012, 2 pages.

* cited by examiner

*Primary Examiner* — Pamela H Weiss
(74) *Attorney, Agent, or Firm* — Muncy, Geissler, Olds & Lowe, PLLC

(57) ABSTRACT

A lube oil composition is provided. The lube oil composition includes a base oil and a carbon nanocapsule grafting with an alkyl group dispersed in the base oil, wherein the carbon nanocapsule is hollow or filled with metal, metal alloy, metal oxide, metal carbide, metal sulfide, metal nitride or metal boride.

6 Claims, No Drawings

LUBE OIL COMPOSITIONS

BACKGROUND OF THE INVENTION

1. Field of the Invention

The invention relates to a lube oil composition, and in particular, to a lube oil composition containing carbon nanocapsules.

2. Description of the Related Art

A carbon nanocapsule is a polyhedral carbon cluster composed of a ball-in-ball multi-layered graphite structure, with a diameter of 3-100 nm, mainly 30-40 nm. A carbon nanocapsule may be hollow or filled with metals. A carbon nanocapsule shell is composed centrally of six-membered rings and marginally of five-membered rings. Each carbon atom is formed of $sp^2$ hybrid orbit. A carbon nanocapsule possesses high thermal conductivity, high electrical conductivity, high strength and chemical stability due to a specific multi-layered graphite structure. A carbon nanocapsule with a protective space can prevent internal metal particles from aggregation, diffusion or oxidation by environmental influence, maintaining internal nano metal structure and quantum effect.

Compared to conventional plated graphite material, the structure of each layer for a spherical carbon nanocapsule is similar to a geodesic dome, with a diameter of about 10 nm to 100 nm. A lubricant agent containing carbon nanocapsules having a closed structure and non-exposure active boundaries possesses superior quality, suitable for use in microelectronics. Conventional layered graphite material is composed of slipped layered compounds. The layered graphite material is a flat slipped gel, with a reduced friction force. However, the layered boundaries are chemically active and slowly decompose and split to connect with metal surfaces following lubrication. Spherical nanoparticles utilize a fine ball bearing rotation to reduce friction force and abrasion. Each nanoparticle can enter gaps of the metal surface. Additionally, such lubricant agent can resist environmental deterioration due to the non-exposure active boundaries of the spherical nanoparticles.

However, dispersal of spherical nanoparticles with non-exposure active boundaries in solvent is difficult. Thus, improvement of dispersion of nanoparticles in an organic phase (lube oil) to reduce friction force is desirable.

BRIEF SUMMARY OF THE INVENTION

One embodiment of the invention provides a lube oil composition comprising a base oil and a carbon nanocapsule grafting with an alkyl group dispersed in the base oil.

The modified carbon nanocapsules grafting with alkyl groups are uniformly dispersed in the lube oil, serving as an optimal additive to improve lubricity, thermal conductivity efficiency and lifespan of the lube oil, suitable for use in mill oil, heat transfer oil, impregnation oil, roller chain oil, engine oil, machine oil and vacuum sealing oil.

A detailed description is given in the following embodiments.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

One embodiment of the invention provides a lube oil composition comprising a base oil and a carbon nanocapsule grafting with an alkyl group dispersed in the base oil.

The carbon nanocapsule may be covalently grafted with the alkyl group having a carbon number of about 12-18, for example, $C_{18}$ stearic acid. The carbon nanocapsule may be hollow or filled with, for example, metal, metal alloy, metal oxide, metal carbide, metal sulfide, metal nitride or metal boride. The carbon nanocapsule shell may be composed of pure carbon or doped with nitrogen, phosphorous or boron. The carbon nanocapsule may have a diameter of 3-100 nm, mainly 30-40 nm. The lube oil composition may be applied to be utilized as, for example, mill oil, heat transfer oil, impregnation oil, roller chain oil, engine oil, machine oil and vacuum sealing oil.

The modified carbon nanocapsules dispersed in the lube oil composition possesses superior properties, for example, high free-radical scavenging ability of $1\times10^8$-$2\times10^8(g/l)^{-1}s^{-1}$, high thermal stability under oxygen exceeding 600° C. and high dispersivity in solvent of 1-10 mg/ml.

The amount of the carbon nanocapsules is altered with various base oils, ranging from 0.005 wt % to 1 wt % based on the weight of the lube oil composition. Compared to the base oils, in the SRV lube oil property test, the load of the 1000 ppm lube oil composition achieved 700N, increasing 56%.

The modification of the carbon nanocapsules is disclosed as follows. First, carbon nanocapsules are dispersed in a solvent such as hydrogen peroxide ($H_2O_2$) to form a hydroxyl group covalently bound to the carbon nanocapsule surface via a free-radical addition. In addition to the hydroxyl group, other suitable additional groups, for example, amino or carboxyl groups formed by proper chemical reactions can also be utilized. The carbon nanocapsules grafted with the hydroxyl group are then reacted with equivalent $C_{12-18}$ alkyl compounds such as $C_{18}$ stearic acid in an acidic solution with reflux. After purification, a lube oil additive, for example, carbon nanocapsules grafted with stearic acid is prepared.

A carbon nanocapsule shell is composed of a closed multi-layered graphite structure. The interior thereof is hollow or filled with metals. Thus, the carbon nanocapsule possesses a large surface area, a stable structure, thermal conductivity and free-radical scavenging ability. Compared to conventional plated graphite material, the spherical carbon nanocapsules improve high-pressure lubricity, thermal conductivity efficiency and free-radical scavenging ability, suitable for use in mill oil, heat transfer oil, impregnation oil, roller chain oil, engine oil, machine oil and vacuum sealing oil. Additionally, the modified carbon nanocapsules are uniformly dispersed in lube oil without use of dispersing agents, which often remain in the oil.

Example 1

Preparation of Oil-Soluble Carbon Nanocapsules

First, carbon nanocapsules were dispersed in hydrogen peroxide ($H_2O_2$) to form a hydroxyl group covalently bound to the carbon nanocapsule surface via a free-radical addition. The carbon nanocapsules grafted with the hydroxyl group ($CNC(OH)_n$) were then reacted with equivalent stearic acid in an acidic solution with reflux.

After purification, a lube oil additive ($CNC(OCOC_{18})_n$) was prepared. In the SRV lube oil property test, the load of the lube oil containing the carbon nanocapsules achieved 700N, increasing 56% from that of base oil, for example, 450N. The properties of the lube oil composition of the invention are shown in Table 1.

TABLE 1

| | | Conventional lube oil | Lube oil containing carbon nanocapsules |
|---|---|---|---|
| SRV pressure test | | 450 N | 700 N |
| Mill oil C310 | Natural heat convection (vertical direction) | — | Increasing 557% than mill oil C310 |
| | Heat capacity (J/g · ° C.) | 2.394 | 1.706 |

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A lube oil composition, comprising:

a lube oil; and a carbon nanocapsule grafting with an alkyl group having a carbon number of 12-18 through an ester bond dispersed in the lube oil, wherein the carbon nanocapsule grafting with the alkyl group is represented by CNC ($OCOC_{12-18}$), wherein CNC is the carbon nanocapsule, $C_{12-18}$ is the alkyl group having a carbon number of 12-18, and OCO is the ester bond connected with the carbon nanocapsule and the alkyl group.

2. The lube oil composition as claimed in claim 1, wherein the carbon nanocapsule is covalently grafted with the alkyl group.

3. The lube oil composition as claimed in claim 1, wherein the carbon nanocapsule is hollow.

4. The lube oil composition as claimed in claim 1, wherein the carbon nanocapsule is filled with metal, metal alloy, metal oxide, metal carbide, metal sulfide, metal nitride or metal boride.

5. The lube oil composition as claimed in claim 1, wherein the carbon nanocapsule is doped with nitrogen, phosphorous or boron.

6. The lube oil composition as claimed in claim 1, wherein the carbon nanocapsule has a diameter of 3-100 nm.

* * * * *